US006073955A

United States Patent [19]

Chonier

[11] Patent Number: 6,073,955

[45] Date of Patent: Jun. 13, 2000

[54] ALPINE SKI BINDING ELEMENT EQUIPPED WITH A DETACHABLE BRAKE

[75] Inventor: Frédéric Chonier, Nevers, France

[73] Assignee: Look Fixation S. A., Nevers, France

[21] Appl. No.: 09/328,089

[22] Filed: Jun. 8, 1999

[30] Foreign Application Priority Data

Jun. 19, 1998 [FR] France ..... 98 07946

[51] Int. Cl.[7] ..... A63C 5/00

[52] U.S. Cl. ..... 280/605; 280/604; 280/611; 280/623; 280/633; 280/634

[58] Field of Search ..... 280/604, 605, 280/611, 623, 634, 633, 809

[56] References Cited

U.S. PATENT DOCUMENTS

| | | | |
|---|---|---|---|
| 3,249,365 | 5/1966 | Beyl . | |
| 3,992,030 | 11/1976 | Salomon | 280/605 |
| 4,061,357 | 12/1977 | Salomon | 280/605 |
| 4,230,337 | 10/1980 | Storandt . | |
| 4,305,604 | 12/1981 | Leichtfried . | |
| 4,355,817 | 10/1982 | Krob et al. | 280/605 |
| 4,763,918 | 8/1988 | Sedlmair | 280/605 |
| 4,872,698 | 10/1989 | Szafranski | 280/605 |
| 5,002,303 | 3/1991 | Freisinger et al. | 280/605 |
| 5,362,086 | 11/1994 | Baron et al. . | |
| 6,022,039 | 2/2000 | Chevalier | 280/605 |

FOREIGN PATENT DOCUMENTS

| | | |
|---|---|---|
| 2 383 681 | 10/1978 | France . |
| 2 447 732A | 8/1980 | France . |
| 2 668 941 | 5/1992 | France . |
| 2 692 804 | 12/1993 | France . |
| 2 741 275 | 5/1995 | France . |
| 2756525A | 6/1979 | Germany . |
| 397 500 | 8/1965 | Switzerland . |

*Primary Examiner*—Brian L. Johnson
*Assistant Examiner*—Deanna Draper
*Attorney, Agent, or Firm*—Bugnion S. A.; John Moettei

[57] ABSTRACT

An alpine binding element equipped with a detachable ski brake (22) comprising a base (23) removably assembled with the binding element. The latter comprises a latch/spring assembly mounted in the base (3) of the binding element or in the rail carrying the body of the binding element, and the brake base (23) having a part (35, 36) interlocking with the latch/spring assembly in such a way that it is retained by the latch, which is itself held in the locked position by the spring.

11 Claims, 6 Drawing Sheets

ALPINE SKI BINDING ELEMENT EQUIPPED WITH A DETACHABLE BRAKE

BACKGROUND OF THE INVENTION

The invention relates to an alpine ski binding element equipped with a detachable ski brake comprising a base removably assembled with the binding element.

The bindings in question may equally well be bindings with two binding elements, front and rear respectively, and bindings with a single central binding element.

For resharpening the edges of the ski using a machine, in particular, it is necessary to be able to remove the ski brake, because the brake arms interfere with this operation. Manufacturers have therefore proposed various solutions for removing the brake. In the binding described in patent FR 2 668 941, the content of which is incorporated by reference, the base of the brake is assembled with the baseplate of the binding by a simple screw. This is also the case with the binding described in patent FR 2 741 275, the content of which is incorporated by reference.

In the binding according to patent FR 2 692 804, the content of which is incorporated by reference, the base of the brake is fixed, on the one hand, by a screw to the baseplate of the binding element and, on the other hand, by two screws of the element for fixing the baseplate to the ski. Removal of the brake therefore requires unscrewing of these two screws fixing it to the ski. However, repeated screwing and unscrewing of these screws results in their being held less firmly in the ski.

In addition, patent application DE 27 56 525, the content of which is incorporated by reference, discloses a binding whose brake is assembled, without a base, directly to the baseplate of the binding element by engaging the brake arms in a groove in the baseplate, in which the brake is locked by means of a piece which is fixed with a catch on the baseplate, with the aim of making it possible to use the binding with or without the brake.

In these known bindings, the brake is therefore fixed to the baseplate of the binding element by means of at least one auxiliary fixing piece that can be fully separated from the binding element. When detaching the brake there is consequently a risk of mislaying the fixing piece, in particular when it is a screw.

In the pivoting heel pieces of the type described in patent CH 397 500, the content of which is incorporated by reference, the conventional way of fixing the base of the brake onto the baseplate of the binding element using screws is virtually impossible because the diameter of the pivot of the pivot-plate is such that, in order to comply with the maximum distance of 70 mm between the pivoting axis of the pivot-plate and the articulation axis of the brake, at which distance the brake is still actuated by the heel of the boot, the screws would have to be located under the pivot-plate.

The applicant has also marketed, in 1980 under the references GT and 77C, toe pieces according to patent FR 2 383 681, the content of which is incorporated by reference. These toe pieces are equipped with a removable brake whose base is provided with two flexible attachment lugs whose ends hook into cutouts in the base of the toe piece. Fitting the brake requires thumb pressure on the flexible lugs, and since these lugs need to be strong and the brake should be fixed securely and as rigidly as possible, the lugs are not very flexible and it takes considerable effort to bend them. They could only be fitted in a more straightforward way at the cost of reduced strength of the brake.

SUMMARY OF THE INVENTION

The object of the present invention is to provide a method of fitting a removable brake which avoids the drawbacks of the prior art designs.

To that end, the ski binding element according to the invention is one which comprises a latch/spring assembly located in the binding element, and wherein the brake base has a part interlocking with the latch/spring assembly in such a way that it is retained by the latch, which is itself held in the locked position by the spring.

The latch/spring assembly may be accommodated in the base of the binding element or in a rail on which the body of the binding element is directly mounted.

The means for assembling the brake with the binding element do not therefore have an element that can be separated from the binding element, and it is straightforward both to fit and to remove the brake.

According to one embodiment, the binding element is a pivoting binding element provided with a base in which an accommodating part is formed, and the brake base has at least one lug which is at least approximately parallel to the plane of the base of the binding element and is provided with a notch, and accommodating part of the base of the binding element, extends at least approximately parallel to the plane of the base of the binding element and has at least one orifice at one end of the base of the binding element and an unlocking orifice, the latch being movable transversely to the base of the binding element, actuatable through said unlocking orifice and engaged, in the locked position, in the notch of the lug of the brake base under the effect of the thrust exerted by said spring.

According to another embodiment, the binding element is a nonpivoting heel piece comprising a body mounted on a rail. Said accommodating part is formed by the bottom of the rail and two vertical walls which are bent and have a cutout, at least one of which extends over at least the majority of the height of the corresponding vertical wall. The latch consists of a plate or bar whose ends are engaged in said cutouts in such a way that at least one of the ends of the plate or bar can move vertically in the corresponding cutout, this plate being provided with at least one protuberance on its upper face and the plate being pushed upward by said spring which is arranged between the bottom of the rail and the plate. The brake base has at least one hole in which the protuberance of the latch engages.

BRIEF DESCRIPTION OF THE DRAWING

The appended drawing represents two embodiments of the invention by way of example.

DETAILED DESCRIPTION OF THE PREFERRED EMBODIMENTS

Figure 1:
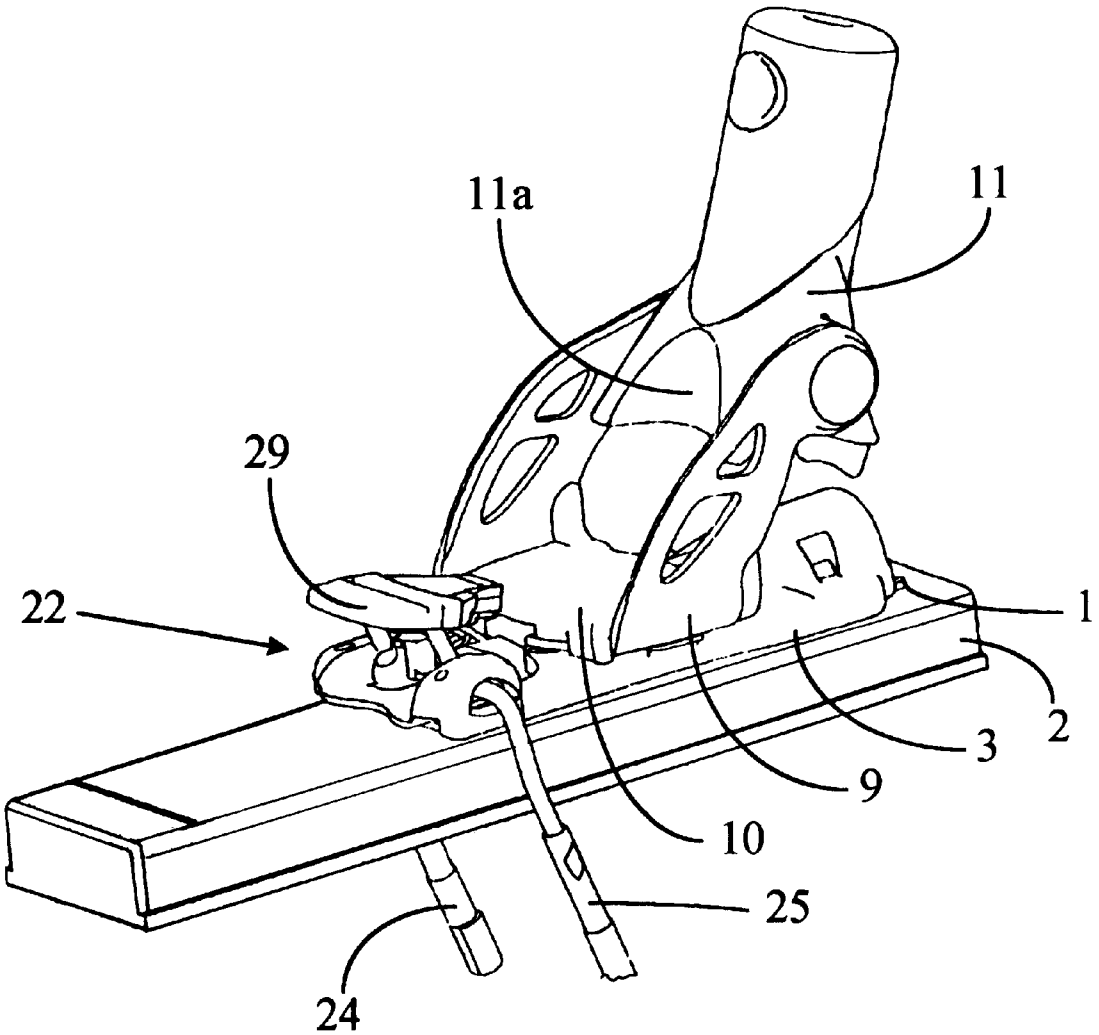
FIG. 1 is a perspective view of a pivoting heel piece which is mounted on a ski and is equipped with its removable brake.

The heel piece represented in FIG. 1 is a pivoting heel piece of the type first described in patent CH 397 500. It comprises a rail 1 which is fixed on a ski 2 and carries a binding element base 3 which is mounted so as to slide on the rail 1, on which it can be moved in the known way by means of a screw 4 secured to the base 3 via a vertical panel 5 which is itself mounted transversely in an accommodating part 6 of the base of the binding element and is held abutting against the bottom of this accommodating part by two springs 7 and 8, so that the base of the binding element 3 can move back, in the known way, on the rail and compress the springs. A stirrup piece 9 is mounted on the base of the binding element 3 and can pivot on the base 3 about a vertical axis against the action of a spring which tends to return this stirrup piece 9 to the central position. This stirrup piece 9 is covered by a bearing panel 10, for supporting the heel of the boot, and between its two arms is articulated a body 11 of the binding element whose lower end 11*a* forms a heel grip, as represented and described in patent CH 397 500 and as is well known with this type of binding, one example of which is the LOOK 37 binding.

At the front, the base of the binding element 3 has a rise 12 covering an accommodating part 13 of rectangular overall shape in which a latch 14 is mounted. This latch 14 consists of a metal panel cut so as to have two cutouts of rectangular overall shape 15 and 16 which are open to the front and one of whose sides has a tab 17 and 18, respectively, and a cutout 19 which is open on the side of the latch. This latch 14 can move in the accommodating part 13 transversely with respect to the base of the binding element 3 against the action of a spring 20 working in compression in the cutout 19, between the latch 14 and one of the sides of the accommodation part 13. On the opposite side from the spring 20, the accommodating part 13 has an orifice 21 through which the latch 14 can be pushed back against the action of the spring 20.

The binding element is equipped with a brake 22 mounted removably at the end of the base of the binding element 3. This brake 22 comprises a brake base 23 on which two brake arms 24 and 25 are articulated. These have a substantially horizontal intermediate part, such as 24*a*, passing through holes which are formed in the side faces of the base 23 and are used as bearings for the brake arms 24 and 25. The base 23 is itself mounted in a molded piece 28, which the brake arms also pass through and whose shape has a cam function which produces the outward and inward movement of the brake arms, the upper ends of the brake arms 24 and 25 being articulated under a brake pedal 29 which is in addition articulated onto the brake base 23 via a rod 30, about a pin 31, which rod is subjected to the action of a spring 32 that tends to lift the pedal 29, that is to say keep the brake arms 24 and 25 in the lowered position, in the manner which is known.

The brake base 23 has two lateral lugs 33 and 34 which are bent in a hook shape and hook onto the rail 1, so that the brake base 23 is held and guided by the rail 1 like the base of the binding element 3. The brake base 23 also has two lugs 35 and 36 which are directed parallel to the axis of the base of the binding element 3, that is to say the axis of the rail. These lugs are of rectangular overall shape with a chamfered corner and possess laterally, on the same side as the chamfer, a notch 37 and 38, respectively, in which the tabs 17 and 18 of the latch 14 are engaged. This engagement is such that the brake base 23 is fixed without play in the accommodating part 13 of the base of the binding element.

The accommodating part 13 has a front wall provided with two holes for the lugs 35 and 36 to pass through without play, or at most with little play.

The brake is fitted onto the base of the binding element by a simple thrusting action, the chamfers of the lugs 35 and 36 moving the latch 14 away until it snaps into place.

The brake base 23 is unlocked by means of a flat-head screwdriver inserted into the slot-shaped orifice 21. Turning the screwdriver has the effect of pushing back the latch 14 sideways.

An axial play, due for example to wear and tear, may be eliminated by giving the notches and the tabs a trapezoidal shape.

Figure 4:
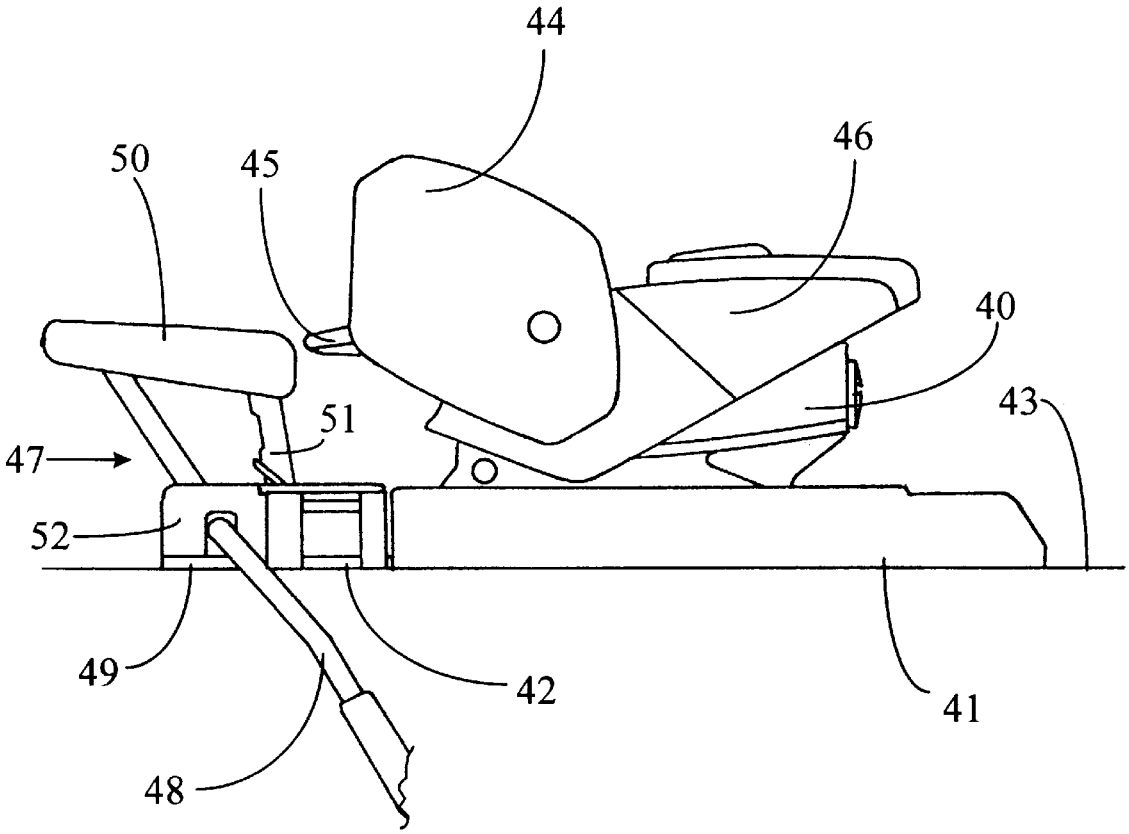
FIG. 4 represents a nonpivoting heel piece equipped with a removable brake mounted on the rail.

The heel piece represented in FIG. 4 is a conventional nonpivoting heel piece comprising a binding body 40 which is mounted so as to slide on a rail 42, itself fixed to the ski 43 and provided with a guard 41. In the known way, the body 40 of the binding element can be positioned along the rail 42. A heel grip 44 with its pedal 45 and a boot release lever 46 can be seen mounted on the body of the binding element 40. The heel piece is provided with a ski brake 47 similar to the brake 22 in the first embodiment. Once again there are two ski brakes 48 which are mounted so as to pivot on a brake base 49 and whose upper ends are articulated onto a brake pedal 50 that is further connected to the brake base by a rod 51. The brake base 49 is also covered with a cap 52.

The way in which the brake is removably assembled with the heel piece will now be described with reference to FIG. 5 to 8.

The brake base 49 has a longitudinal extension 53 which is bent into an S-shape so as to have a first, bottom horizontal part 54 and a second, top horizontal part 55 connected by an oblique part 56. A rectangular cutout 57 is formed in the bend formed by the parts 54 and 56. The flat part 55 has two circular holes 58 and 59.

The rail 42 has an extension 60 at the end nearest the brake. This extension itself has two parallel vertical and bent side walls 61, 62 which, with the bottom 63 of the rail, form an accommodating part of rectangular cross section. The walls 61 and 62 also have a cutout 64 and 65, respectively.

Figure 5:
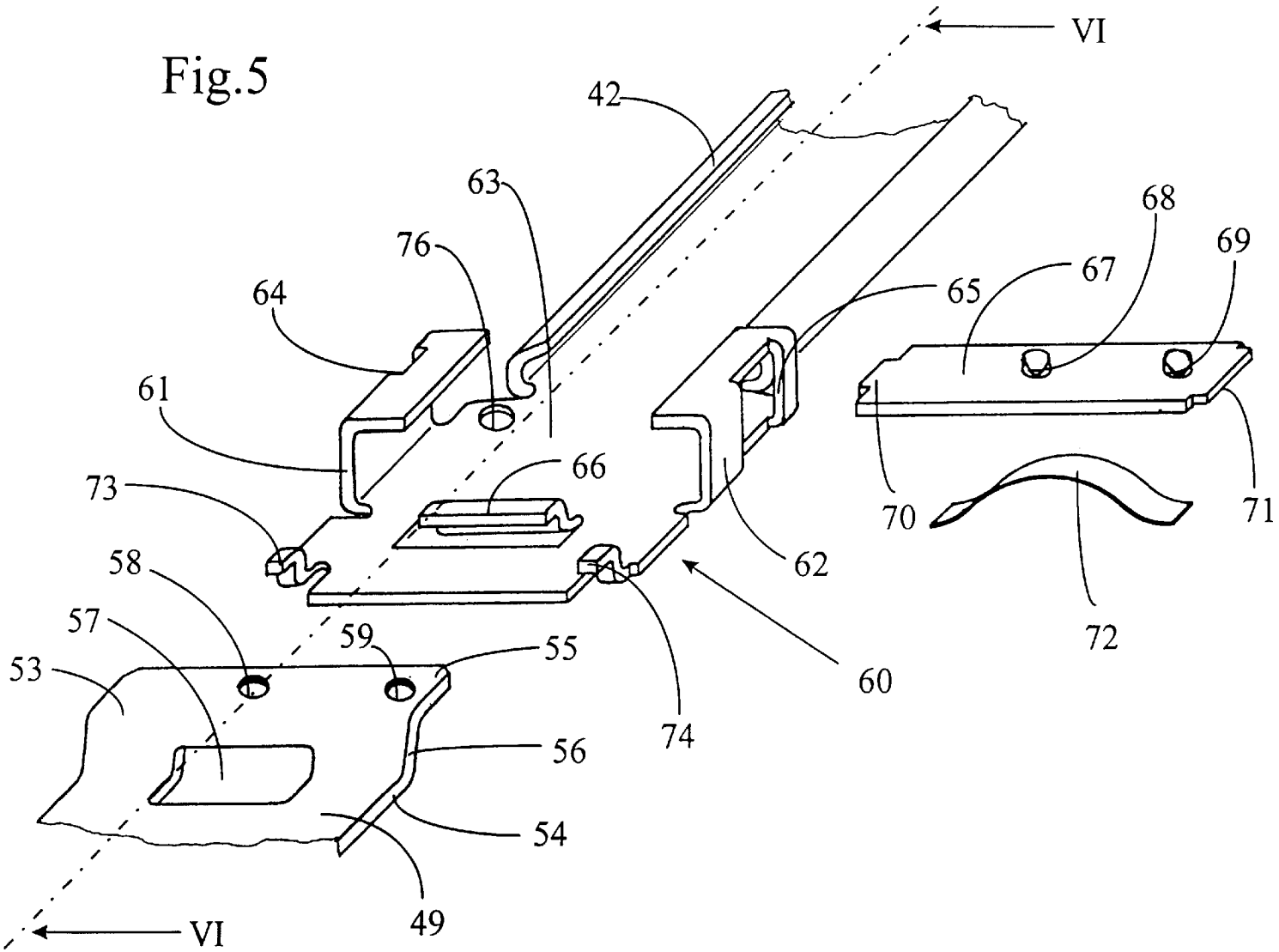
FIG. 5 is an exploded view of the rail of the heel piece represented in FIG. 4.
Figure 6:
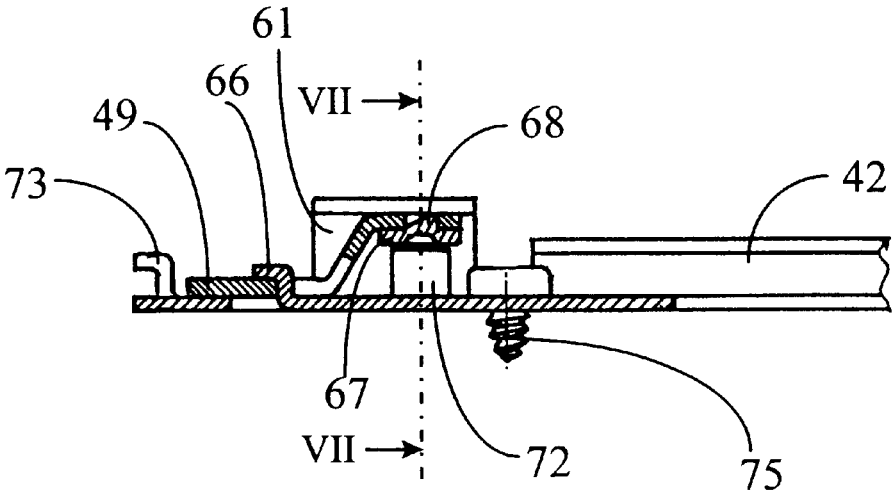
FIG. 6 is a view in section on VI—VI in FIG. 5.

The cutout 64 is located on the upper bend of the wall 61 and extends only slightly below this bend, while the cutout 65 extends over the entire height of the wall 62. The bottom 63 of the extension 60 of the rail also has a part 66 which is cut out, raised and bent into an S-shape so as to form a hook which is bent in the direction of the brake and whose length, transversely with respect to the rail, and height are such that the brake base 49 can just engage under this hook 66 which passes through the cutout 57 during this engagement. Mounted in the accommodating part formed by the walls 61 and 62 is a latch which consists of a plate 67 provided, on its upper face, with two studs 68, 69 which are of cylindrical overall shape and whose diameters correspond to the diameters of the holes 58 and 59. The upper faces of the studs consist of planes inclined in the direction of the brake. At its ends, the plate 67 has two narrowed parts 70 and 71 forming tabs which are engaged respectively in the cutouts 64 and 65. When the brake is not present, the plate 67 is held against the bent parts of the wall 61 and 62 by a spring 72 which bears on the bottom 63. The stud 69 abuts against the bent part of the wall 62. The end of the extension 60 of the rail also has two raised lateral lugs 73 and 74 forming an extra guide for the brake base 49. FIG. 6 also shows one of the screws 75 for fixing the rail 42 to the ski, which screw passes through a hole 76 (FIG. 5).

Figure 7:
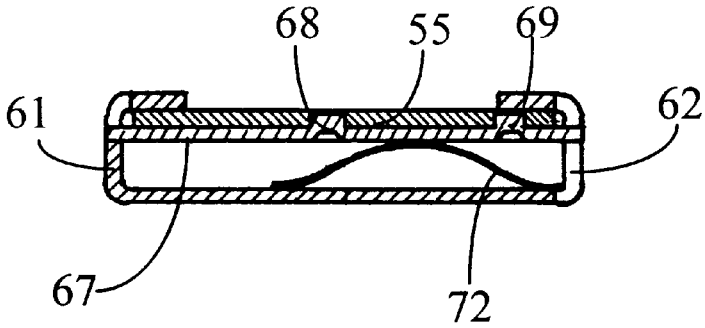
FIG. 7 is a view in section on VII—VII in FIG. 6.

In order to assemble the brake with the heel piece, all that needs to be done is to introduce the bent part 53 of the brake base 49 between the walls 61 and 62 of the rail. The part 55 moves the plate 67 away by virtue of the inclined plane of the studs 68 and 69, until these studs snap into the holes 58 and 59 of the brake base, as represented in FIGS. 6 and 7. The brake base also engages under the hook 66.

Figure 8:
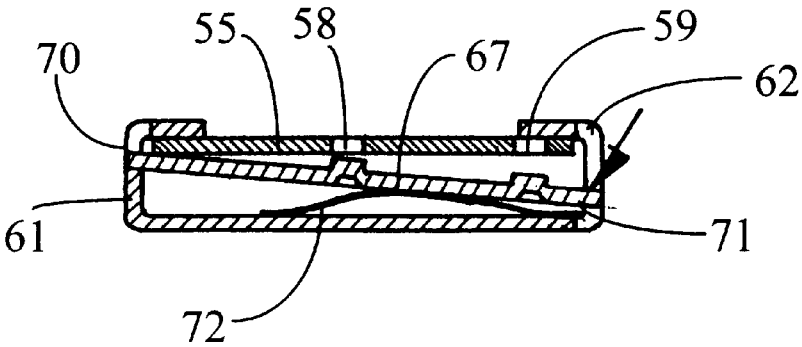
FIG. 8, which is similar to FIG. 7, represents the latch in the unlocked position.

In order to separate the brake from the heel piece, all that needs to be done is to press on the end 71 of the latch 67, for example using a screwdriver, as indicated in FIG. 8. The latch 67 pivots about its opposite end 70 and releases the part 55 of the brake base.

Instead of the studs 68 and 69, the latch 67 could have any other form of protuberance, in particular a single protuberance of rectangular shape interacting with a correspondingly shaped hole in the brake base.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. An alpine ski binding element equipped with a detachable ski brake (22; 47) comprising a base (23; 49) removably assembled with the binding element, which comprises a latch/spring assembly (14, 20; 67, 72) located in the binding element, and wherein the brake base (23; 49) has a part (35, 36; 53) interlocking with the latch/spring assembly in such a way that it is retained by the latch (14; 67), which is itself held in the locked position by the spring (20; 72).

2. A binding element as claimed in claim 1, wherein the latch (14) moves at least approximately horizontally.

3. A binding element as claimed in claim 1, wherein the latch (67) moves at least approximately vertically.

4. A ski binding element as claimed in claim 1, comprising a base (3) on which a boot retaining device (9, 11) is mounted, wherein the latch/spring assembly (14, 20) is disposed in the base of the binding element (3).

5. A binding element as claimed in claim 4, wherein the brake base (23) has at least one lug (35, 36) which is at least approximately parallel to the plane of the base of the binding element and is provided with a notch (37, 38), and wherein the latch/spring assembly (14, 20) is mounted in an accommodating part (13) of the base of the binding element (3), this accommodating part extending at least approximately parallel to the plane of the base of the binding element and having at least one orifice at one end of the base of the binding element and an unlocking orifice (21), said latch (14) being movable transversely to the base of the binding element, actuatable through said unlocking orifice and engaged, in the locked position in the notch of the lug of the brake base under the effect of the thrust exerted by said spring (20).

6. A binding element as claimed in claim 5, wherein the brake base (23) is provided with two rectangular lugs (35, 36) and wherein the latch (14) is of rectangular overall shape and laterally has two cutouts (15, 16) which are provided with tabs (17, 18) and which receive said lugs and a cutout (19) in which the locking spring is disposed.

7. A binding element as claimed in claim 5, wherein the unlocking orifice (21) is located on the opposite side of the base of the binding element from the locking spring (20).

8. A binding element as claimed in claim 5, wherein the notch (37, 38) and the tab (17, 18) are of trapezoidal shape.

9. A binding element as claimed in claim 5, the base (3) of which is mounted on a rail, wherein the brake base (23) has lateral lugs (33, 34) curved so as to hook onto the rail.

10. A binding element as claimed in claim 1, the body (40) of which is mounted on a rail (42), wherein the latch/spring assembly (67, 72) is accommodated in the rail.

11. A binding element as claimed in claim 10, wherein the latch/spring assembly is arranged in an accommodating part formed by the bottom (63) of the rail and by two vertical walls (61, 62) which are bent and have a cutout (64, 65), at least one (65) of which extends over at least the majority of the height of the corresponding vertical wall, and wherein the latch consists of a plate or bar (67) whose ends are engaged in said cutouts in such a way that at least one of the ends of the plate can move vertically in the corresponding cutout, this plate being provided with at least one protuberance (68, 69) on its upper face and the plate being pushed upward by said spring (72) which is arranged between the bottom of the rail and the plate, the brake base having at least one hole (58, 59) in which the protuberance of the latch engages.

* * * * *

UNITED STATES PATENT AND TRADEMARK OFFICE

CERTIFICATE OF CORRECTION

PATENT NO. : 6,073,955
DATED : June 13, 2000
INVENTOR(S) : Chonier

It is certified that error appears in the above-identified patent and that said Letters Patent is hereby corrected as shown below:

Title page, column 1,
Item [73] Assignee: Look Fixation S.A. should read:
-- Look Fixations S.A. --

Column 2,
Attorney, Agent, or Firm-Bugnion S.A.; John Moettei-, the name of the attorney should read: -- John Moetteli --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,073,955
DATED : June 13, 2000
INVENTOR(S) : Chonier

Figure 2:
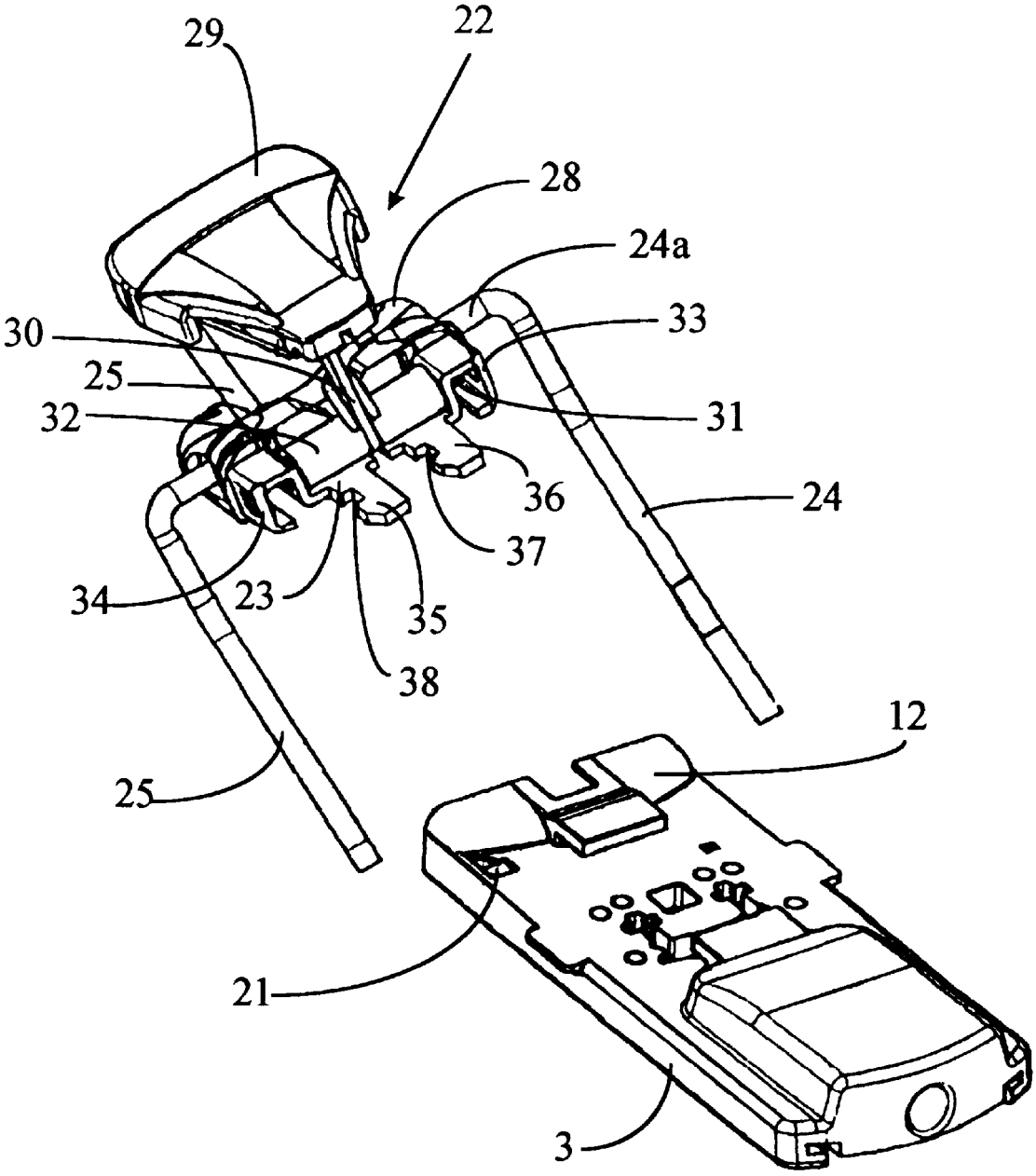
FIG. 2 is a perspective view of the base of the binding element and of the brake in the detached state.
Figure 3:
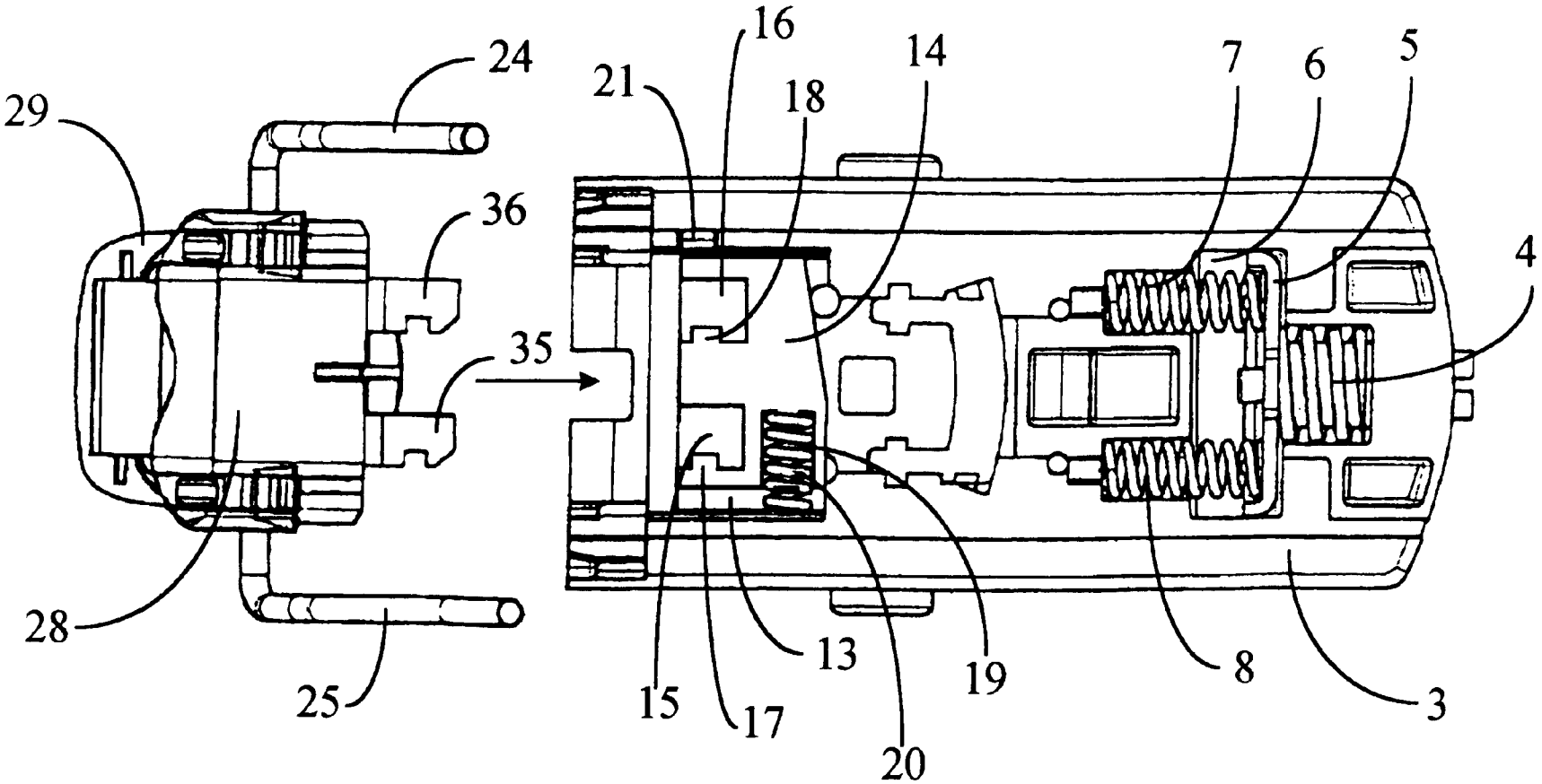
FIG. 3 is a view from below of the base of the binding element and of the brake in the detached position.

It is certified that error appears in the above-identified patent and that said Letters Patent is hereby corrected as shown below:

On page 3, replace Fig. 2 by the Figure 2 as shown below:

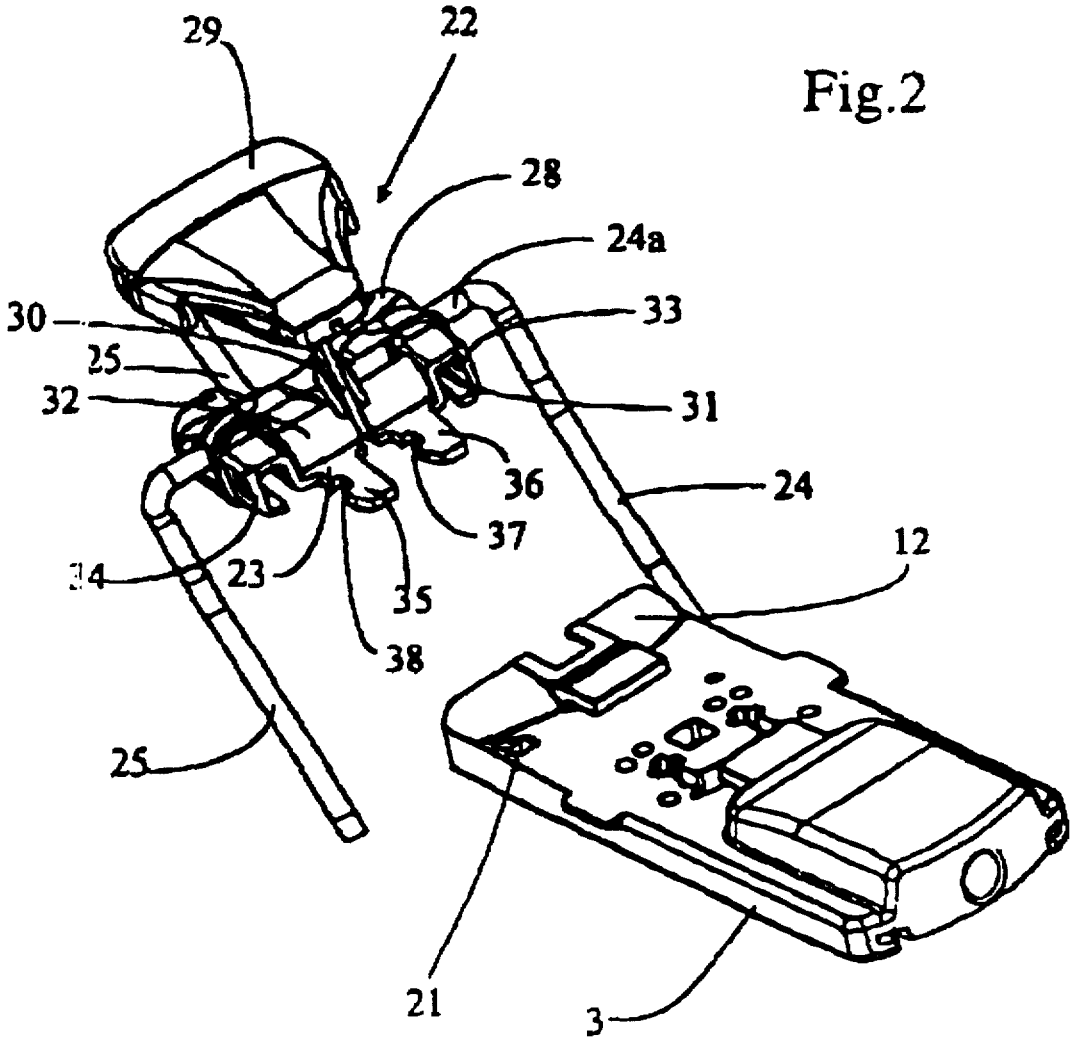

Fig.2